US007321335B2

(12) United States Patent
Egorov

(10) Patent No.: US 7,321,335 B2
(45) Date of Patent: Jan. 22, 2008

(54) ANTENNA CONFIGURATION CHANGE

(75) Inventor: Igor Egorov, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 11/530,331

(22) Filed: Sep. 8, 2006

(65) Prior Publication Data

US 2007/0247373 A1 Oct. 25, 2007

Related U.S. Application Data

(60) Provisional application No. 60/745,328, filed on Apr. 21, 2006.

(51) Int. Cl.
*H01Q 1/24* (2006.01)

(52) U.S. Cl. ..... 343/702; 343/700 MS

(58) Field of Classification Search ..... 343/700 MS, 343/702, 846, 876
See application file for complete search history.

(56) References Cited

U.S. PATENT DOCUMENTS 6,417,807 B1 * 7/2002 Hsu et al. ..... 343/700 MS
6,501,427 B1 * 12/2002 Lilly et al. ..... 343/700 MS
6,529,749 B1 * 3/2003 Hayes et al. ..... 455/575.7
6,950,065 B2 * 9/2005 Ying et al. ..... 343/700 MS
2006/0262015 A1 * 11/2006 Thornell-Pers et al. ..... 343/702
2007/0069956 A1 * 3/2007 Ozkar ..... 343/700 MS
2007/0069958 A1 * 3/2007 Ozkar ..... 343/700 MS

* cited by examiner

*Primary Examiner*—Tan Ho
(74) *Attorney, Agent, or Firm*—Harrity Snyder, LLP

(57) ABSTRACT

A Portable communication device includes in an interior of the portable communication device a ground plane and an antenna arrangement. The antenna arrangement includes an antenna element combination including a first radiating antenna element to be connected to a feeding potential and dimensioned for resonating in a first frequency band, and a second radiating antenna element dimensioned for resonating in a second frequency band. The antenna arrangement further includes at least one first element joining switch that in a closed position interconnects elements of the antenna element combination for dimensioning the antenna element combination for resonating in a third frequency band and in an open position separates these elements from each other, and a grounding switch which in a closed position joins the second radiating antenna element to a ground plane and in an open position separates the second radiating antenna element from the ground plane.

16 Claims, 4 Drawing Sheets

ANTENNA CONFIGURATION CHANGE

RELATED APPLICATION

This application claims priority under 35 U.S.C. § 119 based on U.S. Provisional Application Ser. No. 60/745,328, filed Apr. 21, 2006, the disclosure of which is incorporated herein by reference.

FIELD OF THE INVENTION

Implementations consistent with principles of the invention relate to the field of antennas and more particularly to an antenna arrangement to be provided in the interior of a portable communication device and a portable communication device with such an antenna arrangement.

BACKGROUND OF THE INVENTION

There is a trend within the field of portable communicating devices, and especially within the field of cellular phones to have the antenna built into the phone itself. At the same time, there is often a need for several frequency bands for such phones. There are several reasons for providing different frequency bands. First, some networks provide several frequency bands in order to better distribute traffic in the network. For example, GSM provides two separate bands that can be used. There are also different types of networks in different countries that use different frequency bands.

It is not a simple task to provide an antenna arrangement that can be used with good efficiency in several bands, especially if the antenna is to be based on a Planar Inverted F Antenna (PIFA) antenna and perhaps provided in a small phone.

Various methods have been developed to achieve the additional bandwidth such as using parasitic elements that can be end coupled or side coupled.

When providing such an antenna arrangement, there is in addition often a requirement to keep the antenna arrangement as small as possible. This is not a simple task to obtain when it is at the same time desired to provide several frequency bands. Since the antenna is to be small, there is furthermore a need to use the antenna volume as efficiently as possible.

SUMMARY OF THE INVENTION

According to a first aspect of the invention, an antenna arrangement is provided in the interior of a portable communication device, comprising an antenna element combination including a first radiating antenna element to be connected to a feeding potential and dimensioned for resonating in a first frequency band, and a second radiating antenna element dimensioned for resonating in a second frequency band; at least one first element joining switch that in a closed position interconnects elements of the antenna element combination for dimensioning the antenna element combination for resonating in a third frequency band and in an open position separates these elements from each other; and a grounding switch which in a closed position joins the second radiating antenna element to a ground potential and in an open position separates the second radiating antenna element from the ground potential.

A second aspect of the invention is directed towards an antenna arrangement including the features of the first aspect, wherein the antenna element combination includes a bridging antenna element and further comprising a second element joining switch, where the first joining switch in a closed position interconnects one of the first radiating antenna element or the second radiating antenna element with the bridging antenna element and in an open position separates the one of the first radiating antenna element or the second radiating antenna element from the bridging element and the second joining switch in a closed position interconnects another one of the first radiating antenna element or the second radiating antenna element with the bridging element and in an open position separates the other one of the first radiating antenna element or the second radiating antenna element from the bridging element.

A third aspect of the invention is directed towards an antenna arrangement including the features of the first aspect, where each element joining switch is to be open when the grounding switch is closed and each element joining switch is to be closed when the grounding switch is open.

A fourth aspect of the invention is directed towards an antenna arrangement including the features of the first aspect, wherein each first element joining switch and grounding switch is arranged to be actuated electrically.

A fifth aspect of the invention is directed towards an antenna arrangement including the features of the fourth aspect, wherein at least one of the first element joining switch or grounding switch includes a semi-conductor switch.

A sixth aspect of the invention is directed towards an antenna arrangement including the features of the fourth aspect, wherein at least one of the first element joining switch or grounding switch includes a Micro-Electro-Mechanical System (MEMS) switch.

A seventh aspect of the invention is directed towards an antenna arrangement including the features of the first aspect, wherein the first radiating antenna element connects to the ground potential.

According to an eighth aspect of the invention a portable communication device comprises in its interior a ground plane; and an antenna arrangement including an antenna element combination having a first radiating antenna element to be connected to a feeding potential and dimensioned for resonating in a first frequency band, and a second radiating antenna element dimensioned for resonating in a second frequency band, at least one first element joining switch that in a closed position interconnects elements of the antenna element combination for dimensioning the antenna element combination for resonating in a third frequency band and in an open position separates these elements from each other, and a grounding switch which in a closed position joins the second radiating antenna element to a the ground plane and in an open position separates the second radiating antenna element from the ground plane.

A ninth aspect of the invention is directed towards a portable communication device including the features of the eighth aspect, wherein the antenna element combination includes a bridging antenna element and further comprising a second element joining switch, where the first joining switch in a closed position interconnects one of the first radiating antenna element or the second radiating antenna element with the bridging antenna element and in an open position separates the one of the first radiating antenna element or the second radiating antenna element from the bridging element and the second joining switch in a closed position interconnects another one of the first radiating antenna element or the second radiating antenna element with the bridging element and in an open position separates the other one of the first radiating antenna element or the second radiating antenna element from the bridging element.

A tenth aspect of the invention is directed towards a portable communication device including the features of the eighth aspect, where each element joining switch is to be open when the grounding switch is closed and each element joining switch is to be closed when the grounding switch is open.

An eleventh aspect of the invention is directed towards a portable communication device including the features of the eighth aspect, wherein each first element joining switch and grounding switch is arranged to be actuated electrically.

A twelfth aspect of the invention is directed towards a portable communication device including the features of the eleventh aspect, wherein at least one first element joining switch or grounding switch includes a semi-conductor switch.

A thirteenth aspect of the invention is directed towards a portable communication device including the features of the eleventh aspect, wherein at least one first element joining switch or grounding switch includes a Micro-Electro-Mechanical System (MEMS) switch.

A fourteenth aspect of the invention is directed towards a portable communication device including the features of the eleventh aspect, further comprising an electronic switch actuation unit arranged to actuate the at least one first element joining switch and the ground switch based on frequency band selections.

A fifteenth aspect of the invention is directed towards a portable communication device including the features of the eighth aspect, wherein the first radiating antenna element connects to the ground plane.

A sixteenth aspect of the invention is directed towards a portable communication device including the features of the eighth aspect, wherein the portable communication device includes a cellular phone.

BRIEF DESCRIPTION OF THE DRAWINGS

Implementations consistent with principles of the invention will now be described in more detail in relation to the enclosed drawings, in which.

DETAILED DESCRIPTION OF THE EMBODIMENTS

A portable communication device according to an embodiment consistent with principles of the invention will now be described in relation to a cellular phone. It will be appreciated that the embodiments consistent with the invention are equally applicable to other types of devices. In one implementation, the phone is a so-called stick-type phone, but can be another type of phone, such as, for example, a clam-shell phone, a flip-type phone, a swivel-type phone, or a slider phone. The portable communication device can also be another type of device, such as, for example, a communication module, a PDA (Personal Digital Assistant), or any other type of portable device communicating with radio waves.

Figure 1:
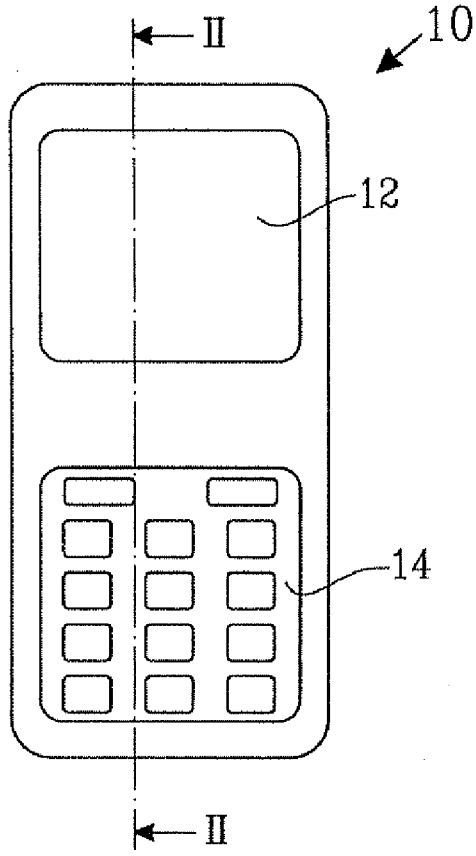
FIG. 1 schematically shows a front view of a stick-type phone.

FIG. 1 schematically shows a front view of a stick-type phone according to one embodiment of the invention. The phone 10 includes a display 12 and a keypad 14. Although not illustrated in FIG. 1, phone 10 may include a built-in antenna.

Figure 2:
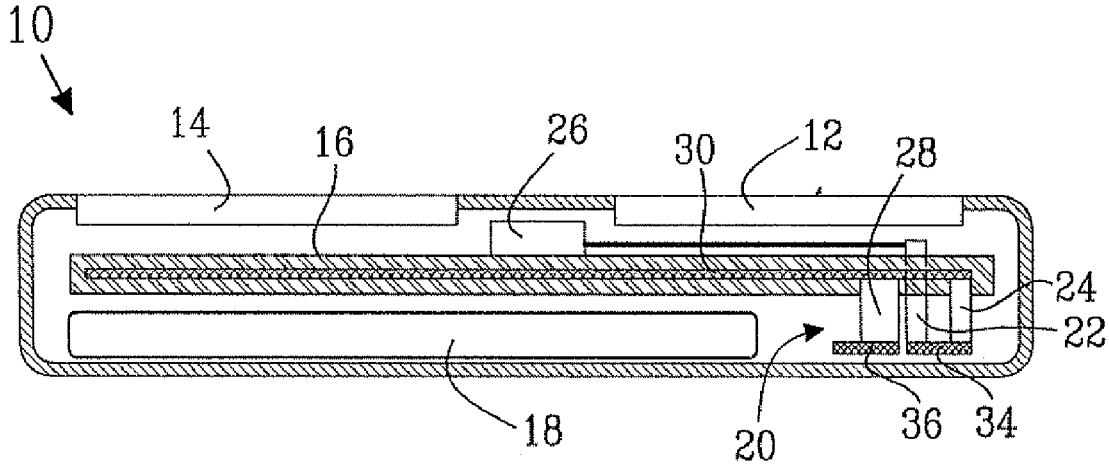
FIG. 2 shows a side view disclosing some of the components and elements in the phone of FIG. 1, FIGS. 3A and 3B schematically show two perspective views of a ground plane and an antenna arrangement according to an embodiment of the invention, where the antenna arrangement has switches set for transmitting in one frequency band, FIGS. 4A and 4B schematically show two perspective views of a ground plane and the same antenna arrangement that is shown in FIGS. 3A and B, where the switches are set for transmitting in two other frequency bands, FIG. 5 schematically shows the antenna elements of the antenna arrangement connected to each other via switches, to an antenna feed and ground as well as an electronic switch actuation unit controlling the switches.

FIG. 2 schematically shows a side view of an exemplary portion of the interior of the phone 10. On a front surface there is provided the keypad 14 and display 12. Below these elements, there is provided a circuit board 16, on which there is provided a radio circuit 26. The radio circuit 26 is provided in order to feed an antenna arrangement 20 according to an embodiment of the invention. The circuit board 16 also includes a ground plane 30 that may stretch the length of the board 16 in the interior thereof. There are of course other components and elements provided on the circuit board 16. Below the circuit board 16 close to a back surface of the phone, there is provided a battery 18 in a battery compartment. The battery 18 is used for providing power to the phone. The battery 18 may, in one embodiment, stretch from a bottom end of the phone and almost up to a top end of the phone. However, the size and placing of the battery 18 can vary in other embodiments. At this top end of phone 10, an antenna arrangement 20 may be provided. The antenna arrangement 20 is here provided below the display 12 and the circuit board 16 and sideways in relation to the battery 18. The antenna arrangement 20 may include a first radiating antenna element 34 and a second radiating antenna element 36 and a feeding pin 22 connected to the radio circuit 26 for receiving radio signals for enabling transmission at suitable frequencies and a first and a second ground pin 24 and 28, respectively, connected to the ground plane of the circuit board 16.

Figure 3A:
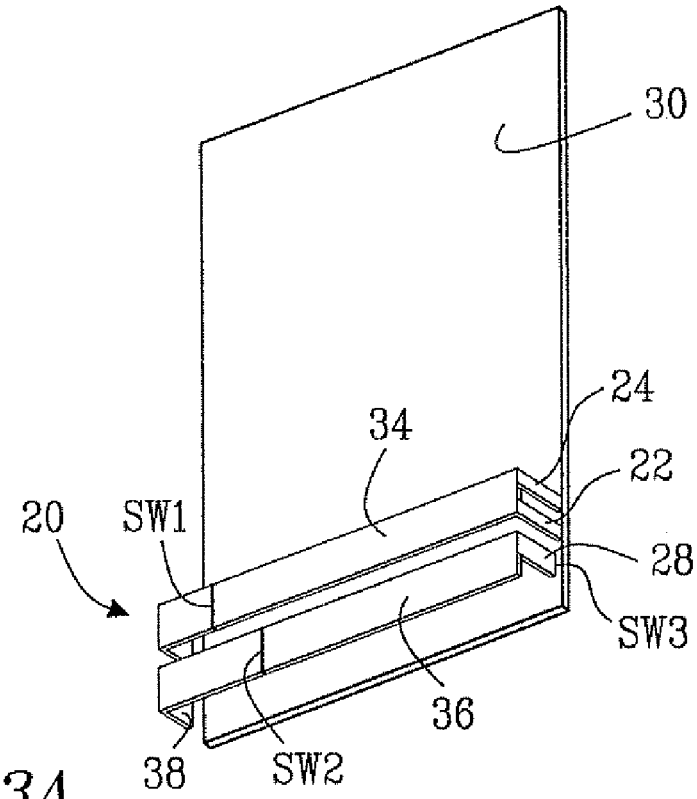
Figure 3B:
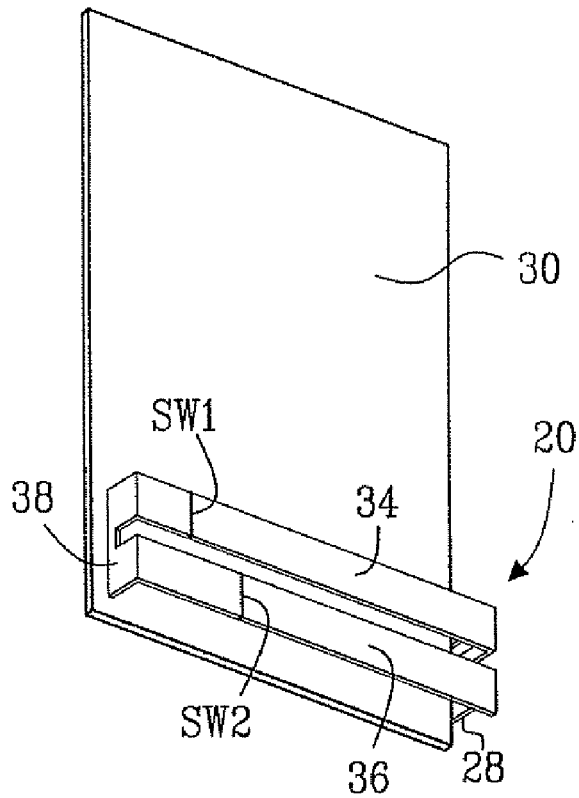

The antenna arrangement 20 according to an embodiment of the invention is schematically shown together with a ground plane 30 in FIGS. 3A and 3B, where FIG. 3A shows a perspective view seen from an angle at a right top side of the antenna arrangement and FIG. 3B from an angle at a left top side. In one embodiment, the antenna arrangement 20 is a multiband PIFA (Planar Inverted-F Antenna) antenna arrangement is the antenna arrangement 20 may be provided with the first radiating antenna element 34 which may be provided in an antenna provision plane parallel to and above the ground plane 30. The first radiating antenna element 34 may be connected to the first ground pin 24, which may be connected to ground 30 for providing a ground potential, and to the feeding pin 22, which in turn may be connected to the radio circuit of FIG. 2 for receiving an antenna feeding potential. In some embodiments, the first radiating antenna element 34 may be essentially shaped as a metallic strip that is dimensioned to be resonating in a first frequency band. In one embodiment, the first radiating antenna element 34 may be provided as a straight strip stretching within the antenna provision plane from one first side of the ground plane 30 in a direction towards a second opposite side of the ground plane 30. The two sides are preferably the long sides of the ground plane 30 that are essentially the long sides of the phone. The first radiating antenna element 34 may furthermore be connected to a bridging element 38 via a first element joining switch SW1. The bridging element 38 may include a first section that stretches within the antenna provision plane straight from the first element joining switch SW1 to the second opposite side of the ground plane 30, where it may be joined to a second U-shaped section provided in a plane that is perpendicular to both the ground plane 30 and the antenna provision plane, where the U-shaped section stretches from the antenna provision plane towards the ground plane 30. One leg of the U may be joined with the first section and the other leg of the U may be joined with a third straight section provided in the antenna provision plane in parallel with the first section. Thus, the third section may stretch within the antenna provision plane from the second opposite side of the ground plane 30 in a direction towards the first side of the ground plane 30. As illustrated in FIG. 3A, the bridging element 38 may be a folded element. The third section of the bridging element 38 may in turn be connected to the second radiating antenna element 36 via a second element joining switch SW2, where the second radiating antenna element 36 stretches within the antenna provision plane in parallel with the first radiating antenna element 34 to the first side of the ground plane 30. The second radiating antenna element 36 may be dimensioned for resonating in a second frequency band. The second radiating antenna element 36 may be connected to the ground plane 30 that provides the ground potential via the second ground pin 28 and a grounding switch SW3. The radiating antenna elements 34 and 36 and the bridging element 38 together form an antenna element combination, which when the element joining switches SW1 and SW2 connects these elements with each other provides a folded PIFA antenna configuration. The antenna element combination may be dimensioned to be resonating in a third frequency band. The element joining switches SW1 and SW2 are indicated by gaps being provided between the radiating antenna elements 34 and 36 and the bridging element 38 and the grounding switch SW3 is indicated by a gap being provided between the second ground pin 28 and the ground plane 30. In one embodiment, antenna arrangement 20 may be provided close to a short side of the ground plane, either a top corner or a bottom corner of the ground plane and aligned with this short side of the ground plane 30 that connects the first and second sides. In one embodiment, the antenna elements may be implemented as printed metal strips on a foil (e.g., copper). The antenna elements may also or alternatively be provided as sheets of suitable metal. It should here be realised that the shape of these elements can be varied in a multitude of ways in order to fit into a limited size area. In one embodiment, the antenna elements may be dimensioned regarding length and width in order to resonate in the different frequency bands. As illustrated, the antenna elements may be enclosed in an antenna volume that is here formed as a rectangular box. It should, however, be realised that the antenna volume may have any desirable shape, for instance cylindrical.

In FIGS. 3A and 3B, the antenna arrangement is provided as a folded PIFA configuration, and the antenna joining switches SW1 and SW2 are closed, which is indicated in the drawings by the gaps between the radiating antenna elements 34 and 36 and the bridging element 38 being filled, while the grounding switch SW3 is open for separating the second radiating antenna element 36 from the ground plane 30, which is indicated by the gap between the second ground pin 28 and the ground plane 30 is non-filled.

Figure 4A:
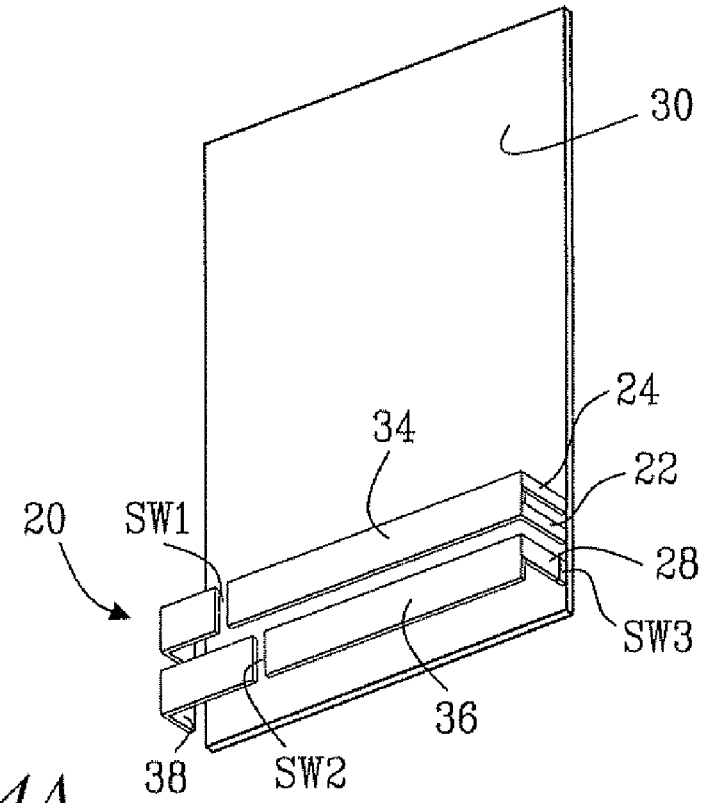
Figure 4B:
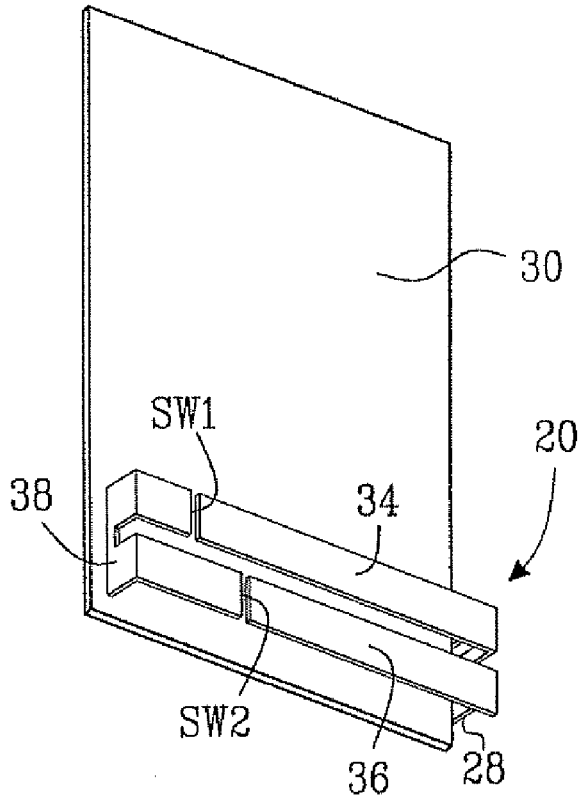

FIG. 4A shows a perspective view from the same side as FIG. 3A, while FIG. 4B shows a perspective view of the antenna arrangement from the same side as FIG. 3B. FIGS. 4A and 4B show the same elements as FIGS. 3A and 3B. The only difference here is that the element joining switches SW1 and SW2 are open for separating the elements of the antenna element combination, which is indicated by non-filled gaps between the radiating antenna elements 34 and 36 and the bridging element 38, and that the ground switch SW3 is closed for joining the second radiating antenna element 36 to the ground potential, which is indicated by a filled gap between the ground plane 30 and the second ground pin 28. With this configuration, there is provided a PIFA antenna with a parasitic element, where the first radiating antenna element 34 is the PIFA antenna and the second radiating antenna element 36 functions as a parasitic element. The bridging element 38 is not used.

The switching of the different switches, according to one embodiment, may be provided through the phone software used for selecting communication band, where a band might be selected by the phone itself or by a user of the phone using, for instance, the keypad.

Figure 5:
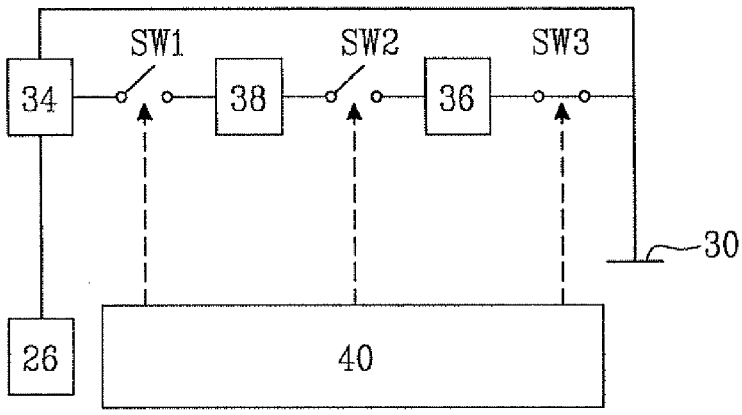

FIG. 5 shows a block schematic of the antenna arrangement and other units for showing how switching may be controlled to change the configuration of the antenna arrangement. In FIG. 5, the first and second radiating antenna elements 34 and 36 and the bridging element 38 are shown as boxes being interconnected via the element joining switches SW1 and SW2. FIG. 5 also shows the grounding switch SW3 connecting the second radiating antenna element 36 to ground 30 and the radio circuit 26 connected to the first radiating antenna element 34 for providing the feeding potential. Also, the first radiating antenna element 34 is shown as being connected to ground 30. There is further shown an electronic switch actuation unit 40 that provides control of all of the switches and that actuates all of the switches electrically, where the control is indicated by dashed arrows between the electronic switch actuation unit 40 and the different switches SW1, SW2 and SW3.

The switch actuation unit 40 may be provided in the form of a processor and corresponding program code for performing switch closing and may be provided together with other band selecting software. The switch actuation unit 40 may be provided as a part of a circuit dedicated to this purpose, like the radio circuit 26, or in some other hardware unit. In one embodiment, the switches SW1, SW2, and SW3 may be implemented as so-called MEMS (Micro-Electro-Mechanical System) switches, but may also be ordinary semiconductor switches.

In one embodiment, the first band may include the 1800 MHz band that may be used in GSM (Global System for Mobile Communication) or DCS (Digital Cellular System). The second band may include the 1900 MHz band that may be used in PCS (Personal Communication Services). The third band may include the 850 MHz band that may be used in GSM. When the third band is selected, the switch actuation unit 40 may close the first and the second element joining switches SW1 and SW2 and open the grounding switch SW3 in order to provide the folded PIFA antenna configuration indicated in FIGS. 3A and 3B. When either the 1800 and/or the 1900 MHz band is wanted, the switch actuation unit 40 may open the first and the second element joining switches SW1 and SW2 and close the grounding switch SW3 to provide the PIFA antenna with parasitic element configuration.

Figure 6:
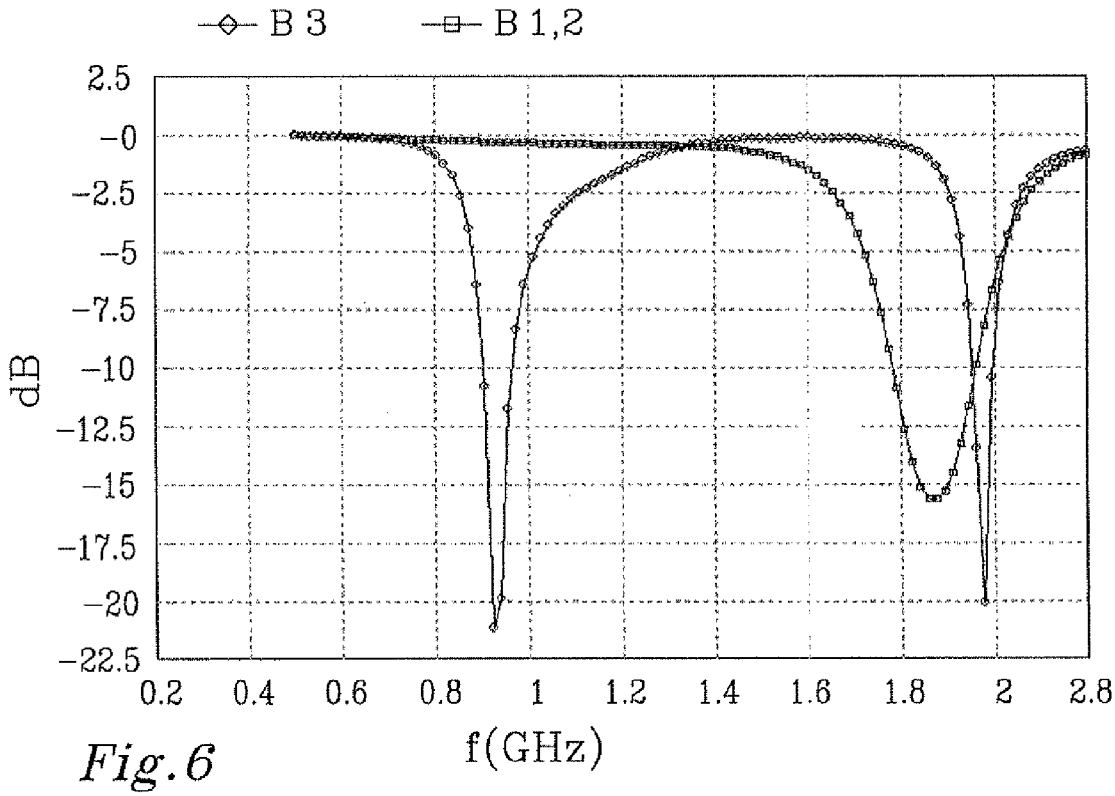
FIG. 6 shows a return loss diagram for the disclosed antenna arrangement and the different switch positions.

FIG. 6 shows a return loss path that has been simulated for the two different antenna configurations, i.e. for the first and second bands B1 and B2 as well as for the third band B3, when these bands are the 1800, 1900 and 850 MHZ bands, respectively. As illustrated in FIG. 6, the results indicate sufficient bandwidth for a triple-band antenna. Note that the folded PIFA antenna configuration (indicated by B3) also has a resonance at high band that covers part of the 1900 MHZ frequency band.

It will be appreciated that the above embodiments are exemplary and that other configurations are possible. For example, embodiments consistent with principles of the invention are not limited to PIFA configurations. Other types of antennas can be implemented. In the antenna element combination, the bridging element might be omitted in some embodiments (e.g., in those situations where the third band can be obtained with only a combination of the first and second radiating antenna elements). In this case, there would thus may be one element joining switch arranged to join the two radiating antenna elements. It is furthermore not necessary with a folded structure, although this has the advantage of using the antenna volume more efficiently.

The grounding switch was shown as being connected between the ground plane and the second ground pin. It can of course also be connected between the second radiating antenna element and the second ground pin or between different parts of the second ground pin. It can thus have any placing as long as it provides the function of making and breaking a connection of the second radiating antenna element and ground plane. The different radiating antenna elements need furthermore not be straight, but may have any structure that is sufficient for obtaining the different bands. This also applies for the bridging element that may have any suitable shape. It should also be appreciated that the antenna provision plane need not be parallel with the ground plane or that the U-shaped section be perpendicular to the ground plane. The first and second antenna elements need not be provided in the same plane at all, but may actually have any shape and alignment in relation to the ground plane that provides the different frequency bands.

The antenna arrangement described herein provides multiband functionality in a limited size antenna arrangement having a limited number of radiating antenna elements. Thus, the antenna arrangement may be small. The antenna arrangement may furthermore use the antenna volume in an efficient way in both configurations in that both the first and the second radiating antenna elements radiate in these configurations. The bridging element, when it is included, may be folded and provided at a side of the ground plane and, thus, may provide the length that is required for resonating in the third band while at the same time guaranteeing that a required distance is kept between the ground plane and the first and second radiating antenna elements. By using switches, it is possible to switch between two different antenna configurations, where each configuration is designed for good performance. Thus, embodiments according to principles of the invention allow the provision of a good performance for each configuration without the need to compromise. The efficiencies of the different bands are furthermore kept high.

The foregoing description of exemplary embodiments provides illustration and description, but is not intended to be exhaustive or to limit the invention to the precise form disclosed. Modifications and variations are possible in light of the above teachings or may be acquired from practice of the invention. For example, embodiments of the invention can use other bands than those described above, such as Universal Mobile Telecommunications System (UMTS) bands. Indeed, the bands mentioned are mere examples of bands where the invention can be used.

It will be apparent to one of ordinary skill in the art that aspects of the invention, as described above, may be implemented in many different forms of software, firmware, and hardware in the implementations illustrated in the figures. The actual software code or specialized control hardware used to implement aspects consistent with the principles of the invention is not limiting of the invention. Thus, the operation and behavior of the aspects of the invention were described without reference to the specific software code—it being understood that one of ordinary skill in the art would be able to design software and control hardware to implement the aspects based on the description herein.

Further, certain portions of the invention may be implemented as "logic" that performs one or more functions. This logic may include hardware, such as a processor, a microprocessor, an application specific integrated circuit, or a field programmable gate array, software, or a combination of hardware and software.

It should be emphasized that the term "comprises/comprising" when used in this specification is taken to specify the presence of stated features, integers, steps or components, but does not preclude the presence or addition of one or more other features, integers, steps, components or groups thereof.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

The invention claimed is:

1. Antenna arrangement to be provided in the interior of a portable communication device, comprising:

an antenna element combination including a first radiating antenna element to be connected to a feeding potential and dimensioned for resonating in a first frequency band, and a second radiating antenna element dimensioned for resonating in a second frequency band;

at least one first element joining switch that in a closed position interconnects elements of the antenna element combination for dimensioning the antenna element combination for resonating in a third frequency band and in an open position separates these elements from each other; and a grounding switch which in a closed position joins the second radiating antenna element to a ground potential and in an open position separates the second radiating antenna element from the ground potential.

2. Antenna arrangement according to claim 1, wherein the antenna element combination further includes:

a bridging antenna element, and wherein the antenna arrangement further comprises:

a second element joining switch, where the first joining switch in a closed position interconnects one of the first radiating antenna element or the second radiating antenna element with the bridging antenna element and in an open position separates the one of the first radiating antenna element or the second radiating antenna element from the bridging element and the second joining switch in a closed position interconnects another one of the first radiating antenna element or the second radiating antenna element with the bridging element and in an open position separates the other one of the first radiating antenna element or the second radiating antenna element from the bridging element.

3. Antenna arrangement according to claim 1, where each element joining switch is to be open when the grounding switch is closed and each element joining switch is to be closed when the grounding switch is open.

4. Antenna arrangement according to claim 1, wherein each first element joining switch and grounding switch is arranged to be actuated electrically.

5. Antenna arrangement according to claim 4, wherein at least one of the first element joining switch or grounding switch includes a semi-conductor switch.

6. Antenna arrangement according to claim 4, wherein at least one of the first element joining switch or grounding switch includes a Micro-Electro-Mechanical System (MEMS) switch.

7. Antenna arrangement according to claim 1, wherein said first radiating antenna element connects to the ground potential.

8. Portable communication device comprising in an interior of the portable communication device:

a ground plane; and an antenna arrangement including:

an antenna element combination including a first radiating antenna element to be connected to a feeding potential and dimensioned for resonating in a first frequency band, and a second radiating antenna element dimensioned for resonating in a second frequency band, at least one first element joining switch that in a closed position interconnects elements of the antenna element combination for dimensioning the antenna element combination for resonating in a third frequency band and in an open position separates these elements from each other, and a grounding switch which in a closed position joins the second radiating antenna element to a ground plane and in an open position separates the second radiating antenna element from the ground plane.

9. Portable communication device according to claim 8, wherein the antenna element combination further includes:

a bridging antenna element, and wherein the portable communication device further comprises:

a second element joining switch, where the first joining switch in a closed position interconnects one of the first radiating antenna element or the second radiating antenna element with the bridging antenna element and in an open position separates the one of the first radiating antenna element or the second radiating antenna element from the bridging element and the second joining switch in a closed position interconnects another one of the first radiating antenna element or the second radiating antenna element with the bridging element and in an open position separates the other one of the first radiating antenna element or the second radiating antenna element from the bridging element.

10. Portable communication device according to claim 8, where each element joining switch is to be open when the grounding switch is closed and each element joining switch is to be closed when the grounding switch is open.

11. Portable communication device according to claim 8, wherein each first element joining switch and grounding switch is arranged to be actuated electrically.

12. Portable communication device according to claim 11, wherein at least one first element joining switch or grounding switch includes a semi-conductor switch.

13. Portable communication device according to claim 11, wherein at least one first element joining switch or grounding switch includes a Micro-Electro-Mechanical System (MEMS) switch.

14. Portable communication device according to claim 11, further comprising:

an electronic switch actuation unit arranged to actuate the at least one first element joining switch and the ground switch based on frequency band selections.

15. Portable communication device according to claim 8, wherein the first radiating antenna element connects to the ground plane.

16. Portable communication device according to claim 8, wherein is the portable communication device includes a cellular phone.

* * * * *